US005660351A

United States Patent [19]

Osanai

[11] Patent Number: 5,660,351

[45] Date of Patent: Aug. 26, 1997

[54] MULTI-SHAFT TURRET TYPE WINDING DEVICE

[75] Inventor: Hiroyuki Osanai, Yokohama, Japan

[73] Assignee: Modern Machinery Co., Ltd., Kanagawa, Japan

[21] Appl. No.: 632,128

[22] Filed: Apr. 15, 1996

[30] Foreign Application Priority Data

Apr. 17, 1995 [JP] Japan ..... 7-090626

[51] Int. Cl.[6] ..... B65H 18/26; B65H 19/30

[52] U.S. Cl. ..... 242/533.4; 242/547

[58] Field of Search ..... 242/533.4, 533.5, 242/533.6, 547

[56] References Cited

U.S. PATENT DOCUMENTS

| | | | |
|---|---|---|---|
| 4,431,140 | 2/1984 | Tetro . | |
| 4,524,919 | 6/1985 | Wehrmann | 242/533.5 |
| 4,971,263 | 11/1990 | Belongia et al. | 242/533.4 |
| 5,035,373 | 7/1991 | Perrigo | 242/533.4 |
| 5,054,707 | 10/1991 | Olson | 242/533.5 |

FOREIGN PATENT DOCUMENTS

| | | |
|---|---|---|
| 58-125553 | 7/1983 | Japan . |
| 295649 | 4/1990 | Japan . |
| 3293250 | 12/1991 | Japan . |

*Primary Examiner*—John M. Jillions

*Attorney, Agent, or Firm*—Sughrue, Mion, Zinn, Macpeak & Seas

[57] ABSTRACT

A multi-shaft turret type winding device including a first turret table on which a plurality of winding mandrels for winding a thin layer film are rotatably arranged, a second turret table on which a plurality of fixing axes are arranged corresponding to the respective winding mandrels, and a touch roller following mechanism in which each touch roller arm having a touch roller attached at a front end is attached at each fixing axis. When a predetermined amount of the thin layer film is wound by one of the winding mandrels at a winding position, the winding mandrel is swung from the winding position to a different position, and another winding mandrel is swung to the winding position by synchronously rotating the first and second turret tables. Under this condition, the touch roller always contacts a product roll of the thin layer film wound on the winding mandrel while maintaining a constant position with respect to the wound thin layer film. When the winding mandrels are being exchanged, air is prevented from being introduced into the product roll.

7 Claims, 9 Drawing Sheets

MULTI-SHAFT TURRET TYPE WINDING DEVICE

BACKGROUND OF THE INVENTION

1. Field of the Invention

The present invention relates to a multi-shaft turret type winding device for winding a thin layer band material such as a plastic film.

2. Description of the Related Art

Various winding devices for winding a thin layer band material such as a plastic film have been conventionally proposed. A Multi-shaft turret type winding device having a plurality of winding, mandrels and continuously winding a thin layer band material is one of the conventional devices.

As shown in FIGS. 6A through 6C, Japanese Published Application (KOKOKU) No. 39303/1994 shows one example of a conventional multi-shaft turret type winding devices. The multi-shaft turret type winding device is capable of winding a plastic film.

In FIG. 6A, winding mandrels (i.e. two winding mandrels) 102*a*, 102*b* are provided, respectively, at the ends of a swingable turret arm 101. A plastic film 103 can be wound at a winding position C by one of the winding mandrels 102*a* while a touch roller 104 contacts a wound plastic film (hereinafter referred to as a "product roll") 103'. The touch roller winds the plastic film 103 while maintaining an appropriate winding angle α and pushes the plastic film 103 toward the product roll 103'.

The plastic film 103 is supplied through a guide roller 105 and wound on the product roll 103' while the plastic film 103 is contacted with the touch roller 104 at an appropriate winding angle. The plastic film 103 is wound around the winding mandrel 102*a*.

Air is prevented from being introduced into a portion between the layers of laminated plastic film of the product roll 103' so that wrinkling of the product roll 103' caused by the introduction of air and improper winding is prevented.

When a winding amount of the product roll 103' on the winding mandrel 102 reaches a predetermined amount at a normal winding position C, the turret arm 101 is rotated as shown in FIGS. 6B and 6C so as to change from the winding mandrel 102*a* to the winding mandrel 102*b*. The plastic film 103 is cut, and a cut edge of the plastic film 103 is wound around the winding mandrel 102*b* which is newly positioned at the winding position C. Thus, the plastic film 103 is successively wound around the winding mandrel 102*b*.

However, as shown in FIG. 6C, in the above described conventional multi-shaft turret type winding device, the touch roller 104 is shifted from a position where the plastic film 103 is contacted with the roll 103' to a different position when the winding mandrel 102*a* is exchanged for the winding mandrel 102*b*. Therefore, a wrinkled or improper portion occurs at the product roll 103' when air is permitted to be introduced into a portion between adjacent films of the product roll 103'. The wrinkled portion of the product roll 103' is not suitable as a product, and the product roll 103' therefore has to be unwound in order to remove the wrinkled portion after finishing a winding operation. This operation has negative influence on the productivity in forming the product roll 103'.

To resolve the above problem, another conventional winding device has been recommended as shown in FIGS. 7A, 7B and 7C. In this winding device, a plurality of touch rollers 104 are provided in order that the touch rollers 104 successively follow a product roll 103' while a winding mandrel 102*a* is exchanged for another winding mandrel 102*b*.

However, in this conventional winding device, the relative position of the product roll 103' with respect to the contacting touch roller 104 is not constant while the roll 103' is removed in order to exchange the positions of the winding mandrels 102*a* and 102*b*. As shown in FIGS. 8A and 8B, the plastic film 103 cannot be wound at an appropriate winding angle and the plastic film 103 is introduced to the winding mandrel 102*a* along a tangent line of the product roll 103'. Therefore, air is introduced between the layers of the plastic film 103 and wrinkled portions sometimes occur.

The purposes of the present invention are to resolve the above described problems and to provide a multi-shaft turret type winding device for winding a thin layer band material such as a plastic film without trapping air bubbles when the winding mandrel is changed for another winding mandrel.

SUMMARY OF THE INVENTION

To accomplish the above purposes, a multi-shaft turret type winding device according to the present invention comprises a plurality of winding mandrels rotatably arranged on a rotatable first turret body. A thin layer band material is wound around one of the winding mandrels at a winding position. When a predetermined amount of the thin layer band material has been wound, the first turret body is rotated so as to swing the winding mandrels at the winding position to a different position and to bring another winding mandrels to the winding position.

The multi-shaft turret type winding device further comprises a second turret body which can synchronously rotate with the first turret body along the same direction and at the same angular velocity, a plurality of fixing axes arranged on the second turret body in position corresponding to the positions of the respective winding mandrels, and a touch roller following mechanism. A touch roller arm having a touch roller located at a front end thereof is pivotably attached at each fixing axis. When the turret bodies rotate, the touch roller always contacts or approaches to the thin layer band material at a constant winding angle with respect to the wound thin layer band material as a result of the operation of the touch roller following mechanism.

The touch roller following mechanism comprises a plurality of main arms, each main arm being attached at the corresponding fixing axis, wherein the main arm can be maintained at a constant position. An elastic force is applied to the wound thin layer band material by a pressure applying device provided between the main arm and the touch roller arm while the turret bodies rotate.

The first and second turret bodies are synchronously rotated along the same direction by a gear transmission mechanism.

When the positions of the winding mandrels exchanged, the first and second turret bodies are synchronously rotated along the same direction by the gear transmission mechanism so that one of the winding mandrels can shift to a position other than a winding position, and the other winding mandrels can shift to the winding position. Simultaneously, fixing axes on the second turret body swing along the same moving course of the winding mandrels on the first turret body, and the main arm provided at the fixing axis always maintains the same position and applies elastic force on the touch roller by the pressure applying device in accordance with the touch roller following mechanism. The touch roller contacts or approaches the thin layer band material wound by the winding mandrels near a position where the thin layer band material is introduced to the winding mandrels, so that the thin layer band material can be wound at an appropriate winding angle and the introduction of air can be prevented.

BRIEF DESCRIPTION OF THE DRAWINGS

Preferred embodiments of the invention will be described with reference to the accompanying drawings, in which.

DESCRIPTION OF THE PREFERRED EMBODIMENTS

Figure 1:
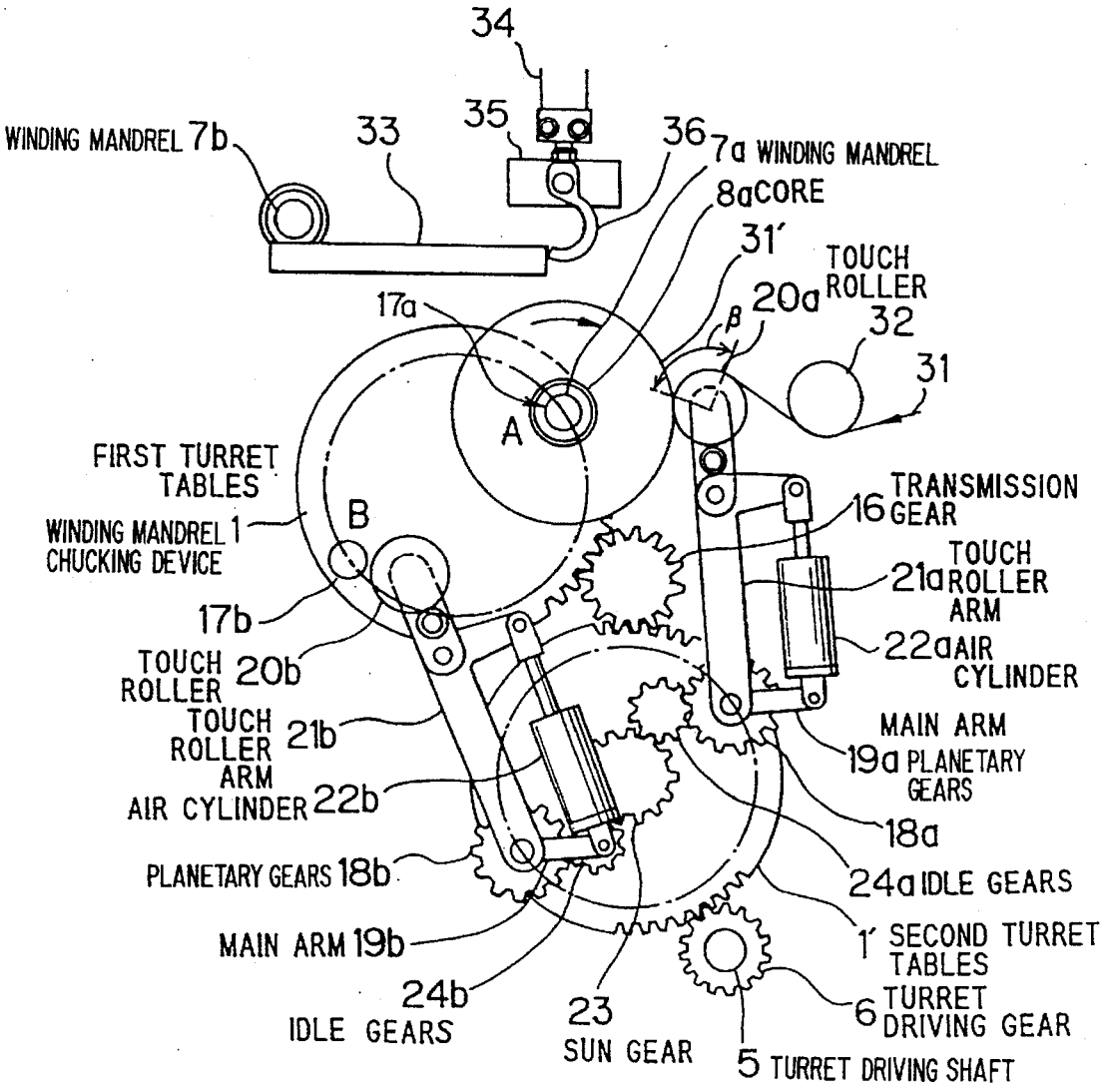
FIG. 1 is a side view of one of the embodiments of a multi-shaft turret type winding device according to the present invention.

A preferred embodiment of the present invention will be explained in detail below.

FIGS.1–5 show one embodiment of a multi-shaft turret type winding device according to the present invention. The winding device is suitable for continuously winding a thin layer band material such as a plastic film.

As shown in the drawings, disc-shaped first and second turret tables 1, 1' are actuated as the first turret body and the second turret body, respectively, and they can rotate on a horizontal axis of a mount table 2.

Ring-shaped guide members 3, 3' are attached to the mount table 2, and ring gears 4, 4' having the same number of teeth and the same module (module=diameter of pitch circle of a gear/number of teeth of the gear ) are integrally attached to a surface of the peripheral portion of the first and second turret tables 1 and 1', respectively. An outer peripheral portion of the ring-shaped guide members 3 (3') engages an inner peripheral portion of the ring gears 4 (4') through ball bearings 12 (12'), so that the ring gears 4 (4') are rotatable.

On the mount table 2, a turret driving gear 6 for engaging with the ring gear 4' is rotatably arranged, and one end of a turret driving shaft 5 is integrally connected to the turret driving gear 6. The opposite end of the turret driving shaft 5 is connected to a turret driving motor 39 through a coupling 40 (40').

In addition, on the mount table 2, a turret driving force transmission gear 16 for engaging both ring gears 4, 4' is arranged, and the turret driving force transmission gear 16 is rotatably supported by a fixed axis 15.

Accordingly, a rotational force of the turret driving motor 39 is transmitted to the turret driving shaft 5 through the coupling 40 (40'), and then the rotational force is transmitted to the ring gear 4' through the turret driving gear 6, and to the ring gear 4 through the turret driving force transmission gear 16. Under this structure, the first and second turret tables 1, 1' are synchronously rotated in the same direction and with the same angular velocity.

Figure 5:
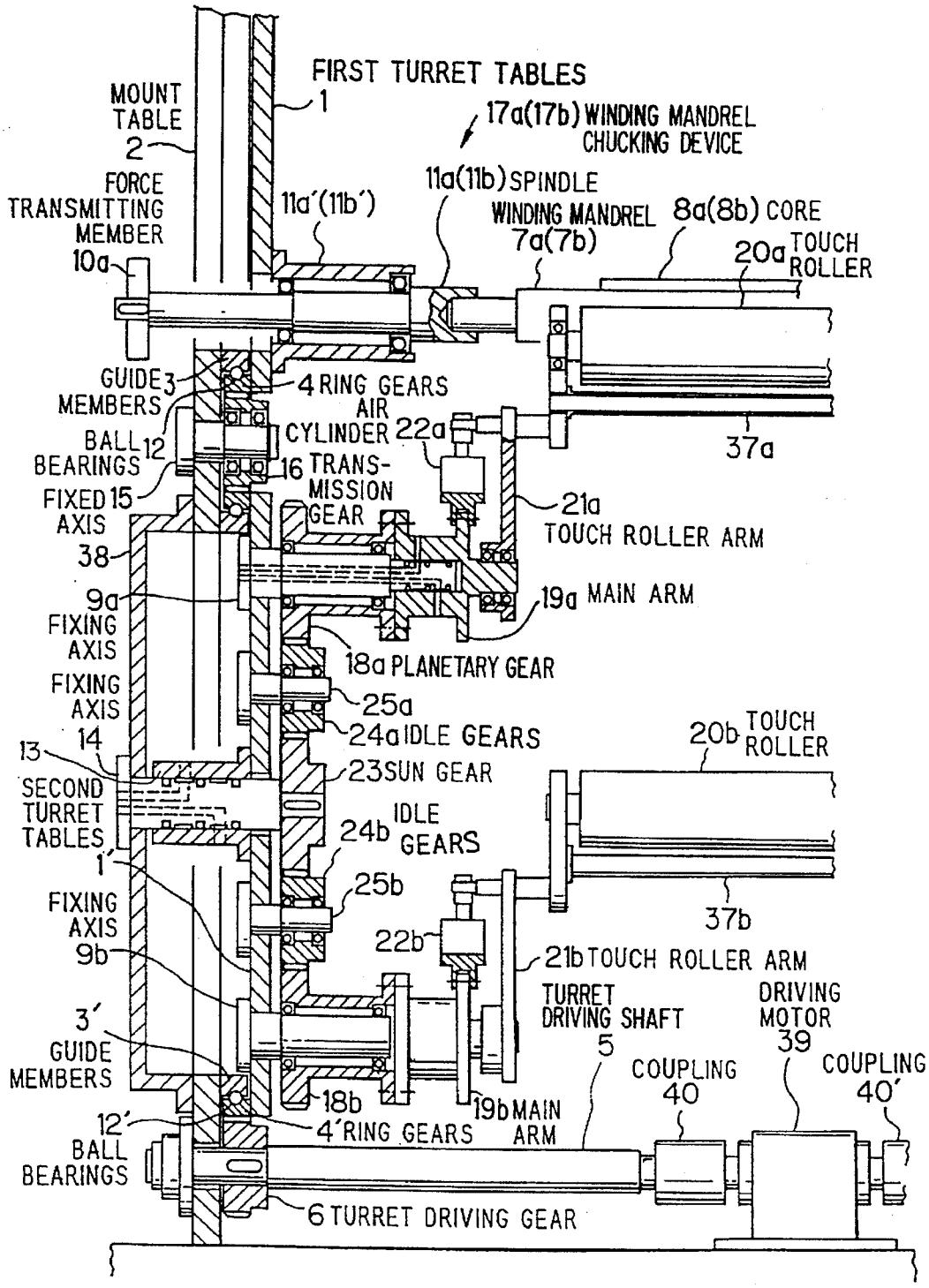
FIG. 5 is a cross sectional view of the embodiment shown in FIG. 1 showing a gear train of a gear mechanism.
Figure 6A:
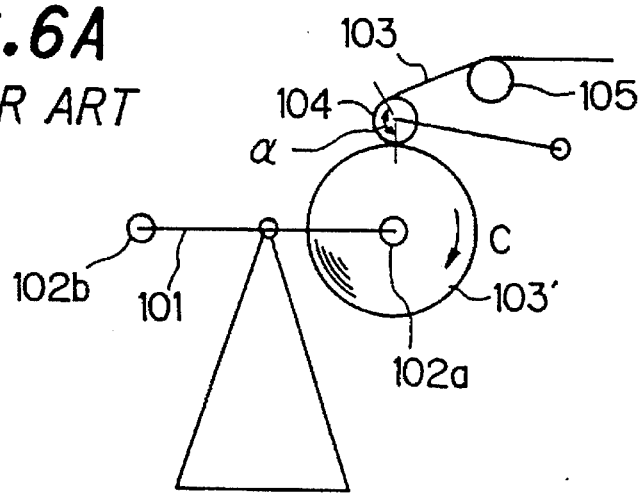
FIG. 6A PRIOR ART
FIGS. 6A, 6B and 6C show an operation of a conventional multi-shaft turret type winding device.
Figure 6B:
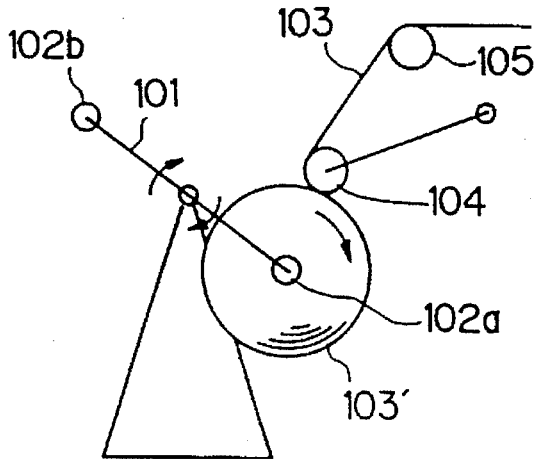
FIG. 6B PRIOR ART
Figure 6C:
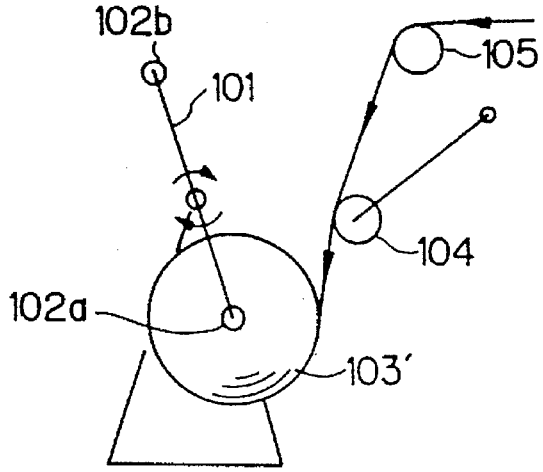
FIG. 6C PRIOR ART
Figure 7A:
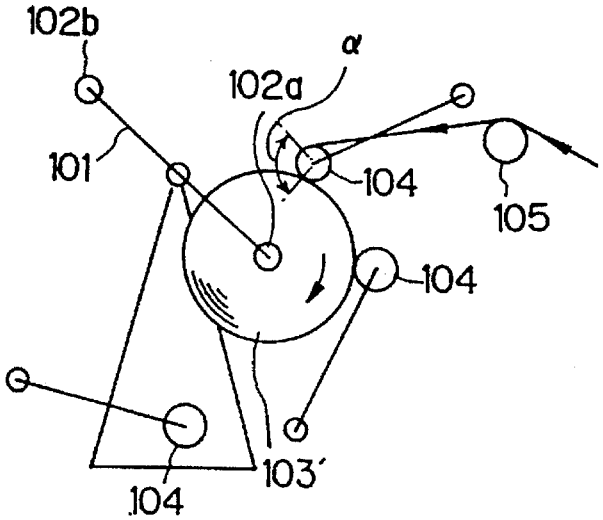
FIG. 7A PRIOR ART
FIGS. 7A, 7B and 7C show an operation of another conventional multi-shaft turret type winding device.
Figure 7B:
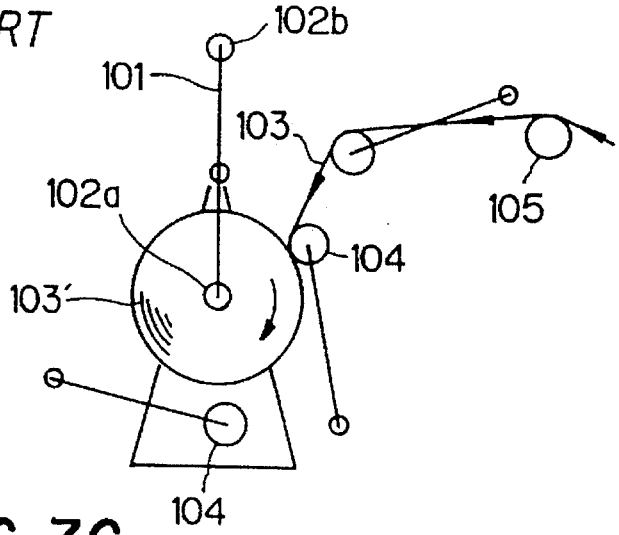
FIG. 7B PRIOR ART
Figure 7C:
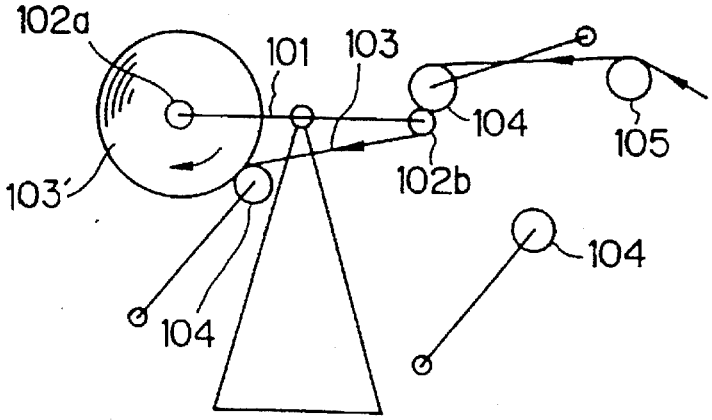
FIG. 7C PRIOR ART
Figure 8A:
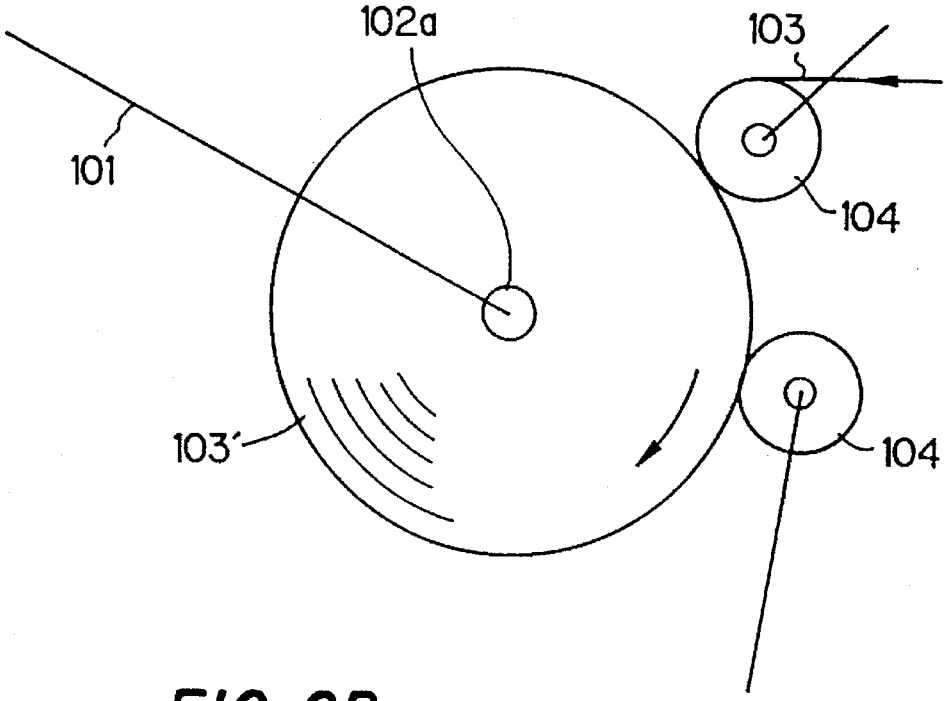
FIG. 8A PRIOR ART
FIGS. 8A and 8B show an operation of exchanging winding axes in the conventional multi-shaft turret type winding device as shown in FIG. 7.
Figure 8B:
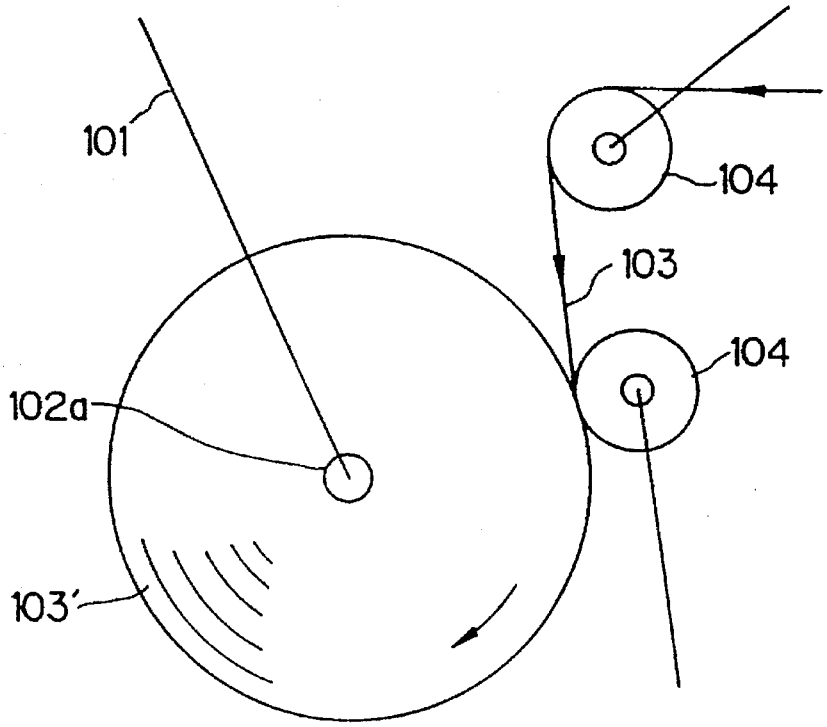
FIG. 8B PRIOR ART

FIG. 5 shows only a left side structure of a winding device including, interalia, the first and second turret tables 1, 1', the ring-shaped guide members 3, 3', the ring gears 4, 4', the turret driving shaft 5, and the turret driving gear 6. A right side structure (not shown) of the winding device is symmetrically arranged. A winding mandrel chucking device 17*a* (17*b*) is provided at the first turret table 1.

As shown in FIG. 5, outer cylinder 11*a'* (11*b'*) is symmetrically provided at a central axis of the first turret table 1. Spindle 11*a* (11*b*) is rotatably supported inside the outer cylinder 11*a'* (11*b'*).

The spindle 11*a* (11*b*) penetrates the first turret table 1. One end of the spindle 11*a* (11*b*) is integrally engaged with a driving force transmit member 10*a* (10*b*) such as a pulley and further connected to a motor for winding (not shown).

Figure 9:
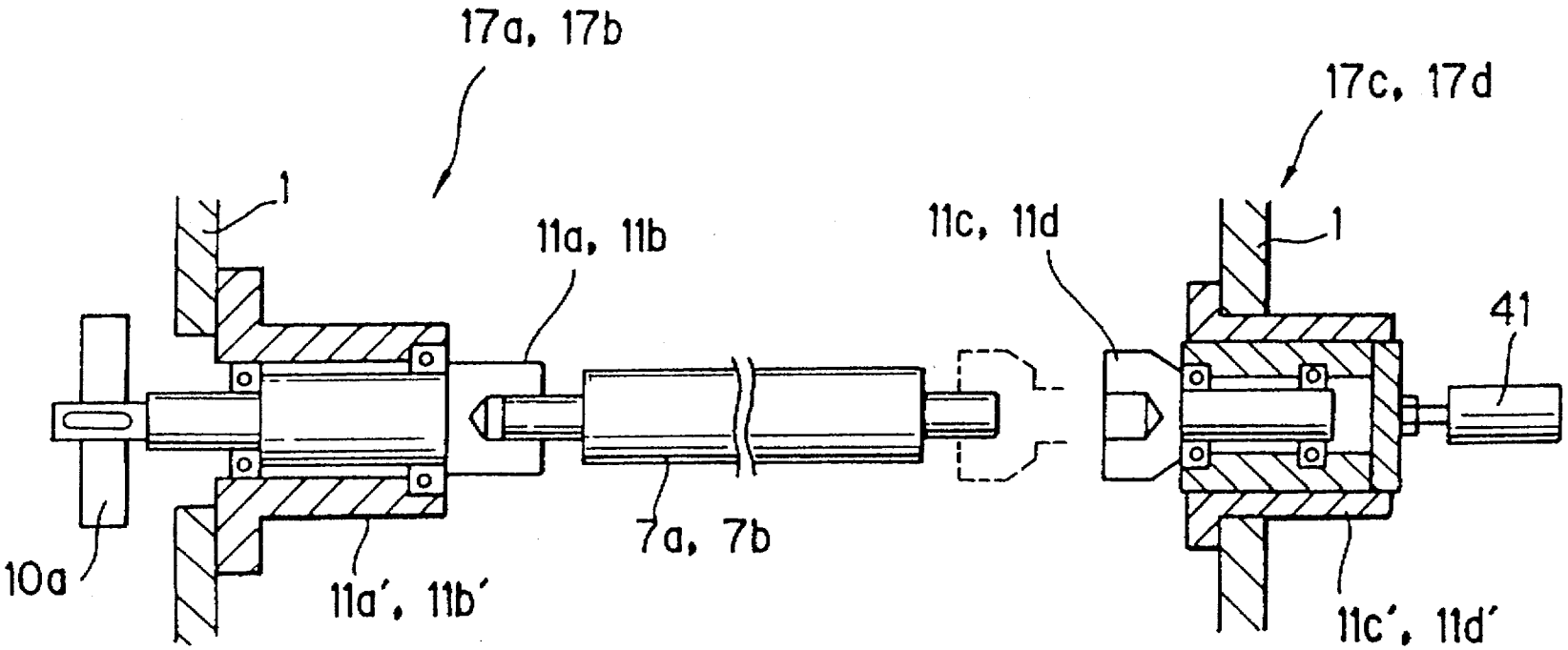
FIG. 9 shows a winding mandrel chucking device of the embodiment according to the present invention.

Further, as shown in FIG. 9, a winding mandrel chucking device 17*c* (17*d*) is provided so as to confront a winding mandrel chucking device 17*a* (17*b*).

On another first turret table 1, outer cylinders 11*c'*, 11*d'* are symmetrically arranged with respect to a central axis of the first turret table 1. Spindle 11*c* (11*d*) is rotatably attached inside the outer cylinder 11*c'* (11d'). Spindle 11*c* (11*d*) is shiftable along a winding mandrel and connected to an air cylinder 41.

As shown in FIG. 9, the spindle 11*c* (11*d*) is moved along an axial direction by driving force of the air cylinder 41 so that the winding mandrel 7*a* (7*b*) can be connected and disconnected with the spindle 11*a* (11*b*) and the spindle 11*c* (11*d*). When the spindle 11*a* (11*b*) is connected to the winding mandrel 7*a* (7*b*), the driving force of a winding motor is transmitted to the spindle 11*a* (11*b*) through a driving force transmitting member 10*a* (10*b*) so that the winding mandrel 7*a* (7*b*) can be rotated for winding.

A core 8*a* (8*b*) on which a plastic film is wound as a product roll 31' can be attached to, and withdrawn from, the winding mandrel 7*a* (7*b*).

The winding mandrel chucking device 17*b* is moved to the winding position A ( shown in FIG. 1) and then the winding mandrel 7*b* is mounted.

An air cylinder 34 for supplying the winding mandrel is arranged above the winding position A. Under the air cylinder 34, a hook 36 is hung by an air cylinder 35 for swinging the hook 36.

Figure 3:
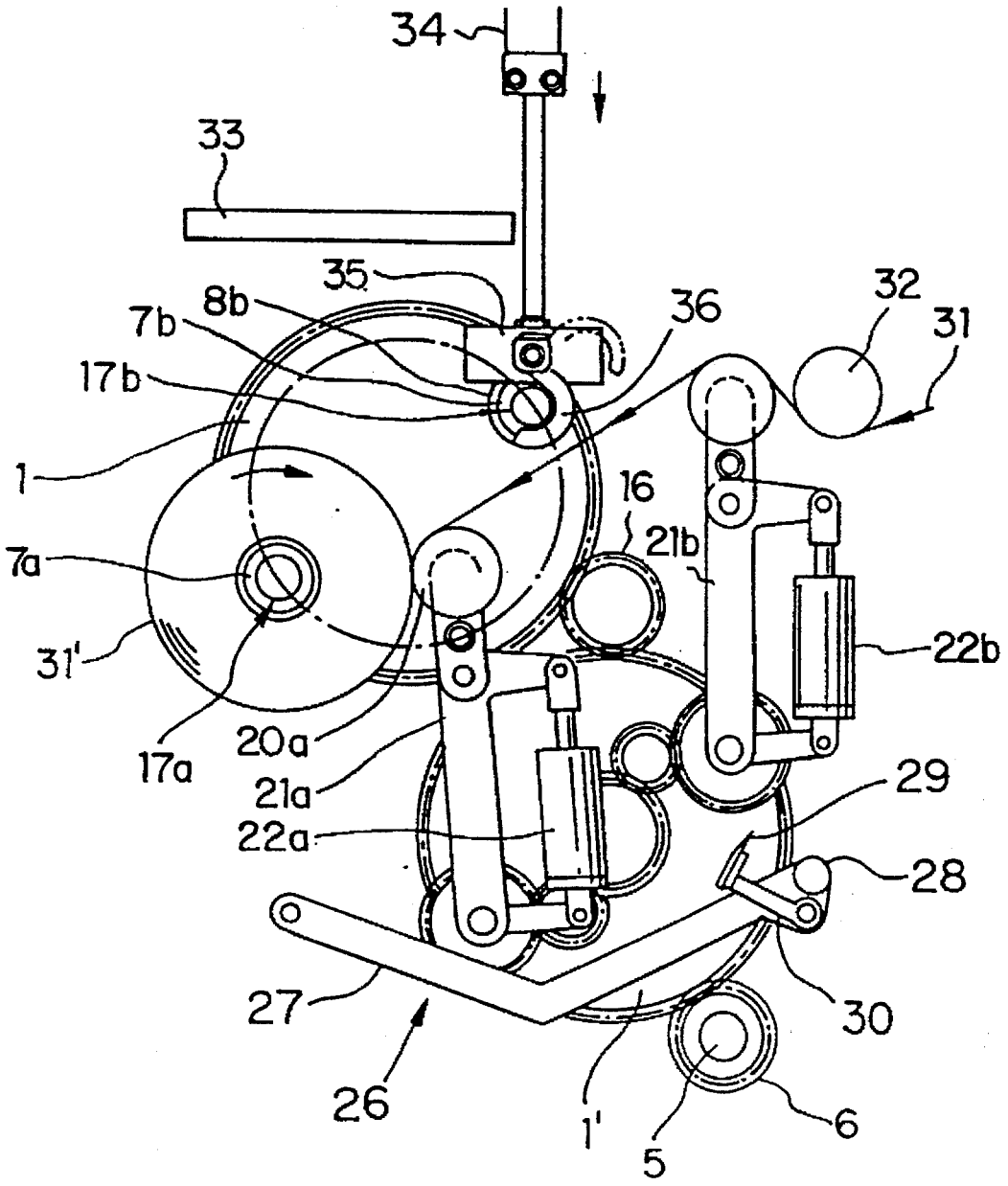
FIG. 3 is a side view of the embodiment shown in FIG. 1 for explaining still another operation.

The hook 36 is movable along a vertical direction by the air cylinder 34, and the winding mandrel 7*b* can be attached to the winding mandrel chucking device 17*b* by actuating the air cylinder 35 as shown in FIG. 3.

A pair of guide rails 33 are arranged beside the air cylinder 34, and the guide rails 33 are supported by the mount table 2. Thus, both ends of the winding mandrel 7*b* are supported by the guide rails 33 and guided to the hook 36.

The winding mandrel 7*b* rolled on the guide rails 33 is engaged with the hook 36, and then the air cylinder 34 is elongated in order to hang the winding mandrel 7*b* and attach the winding mandrel 7*b* at the winding mandrel chucking device 17*b* as shown in FIG. 3. Then, the winding mandrel 7*b* is released from the hook 36 by the air cylinder 35, and the hook 36 is swung to the position shown in FIG. 4.

On the other hand, at a central portion of the second turret table 1', a fixing axis 14 is coaxially penetrated through the second turret table 1'. The fixing axis 14 is fixed and supported by the mount table 2 through a fixing member 38.

A sleeve member 13 is attached on an outer peripheral portion of the fixing axis 14. A sun gear 23 is integrally engaged with one end of the fixing axis 14, and idle gears 24*a*, 24*b* for engaging with the sun gear 23 and planetary gears 18*a*, 18*b* with sleeve members are arranged on the second turret table 1'.

The fixing axis 9*a* (9*b*) is fixed on the second turret table 1' at the point at which the planetary gear 18*a* (18*b*) with a sleeve member is rotatably mounted. The number of teeth and module of the planetary gears 18*a*, 18*b* are the same as those of the sun gear 23.

The positions of fixing axes 9*a*, 9*b* at the second turret table 1' are arranged corresponding to the positions of the winding mandrel 7*a*, 7*b* on the first turret table 1. Distances between the central axis of the second turret table 1' and the fixing axis 9*a* (9*b*) are the same as distances between the central potential portion of the first turret table 1 and the winding mandrel 7*a* (7*b*). The direction from the fixing axis 9*a* to the fixing axis 9*b* is parallel to the direction from the winding mandrel 7*a* to the winding mandrel 7*b*.

The idle gear 24*a* (24*b*) engaging with the sun gear 23 and the planetary gear 18*a* (18*b*) is arranged on the second turret table 1' and the idle gear 24*a* (24*b*) is rotatably supported by the fixing axis 25*a* (25*b*).

Figure 2:
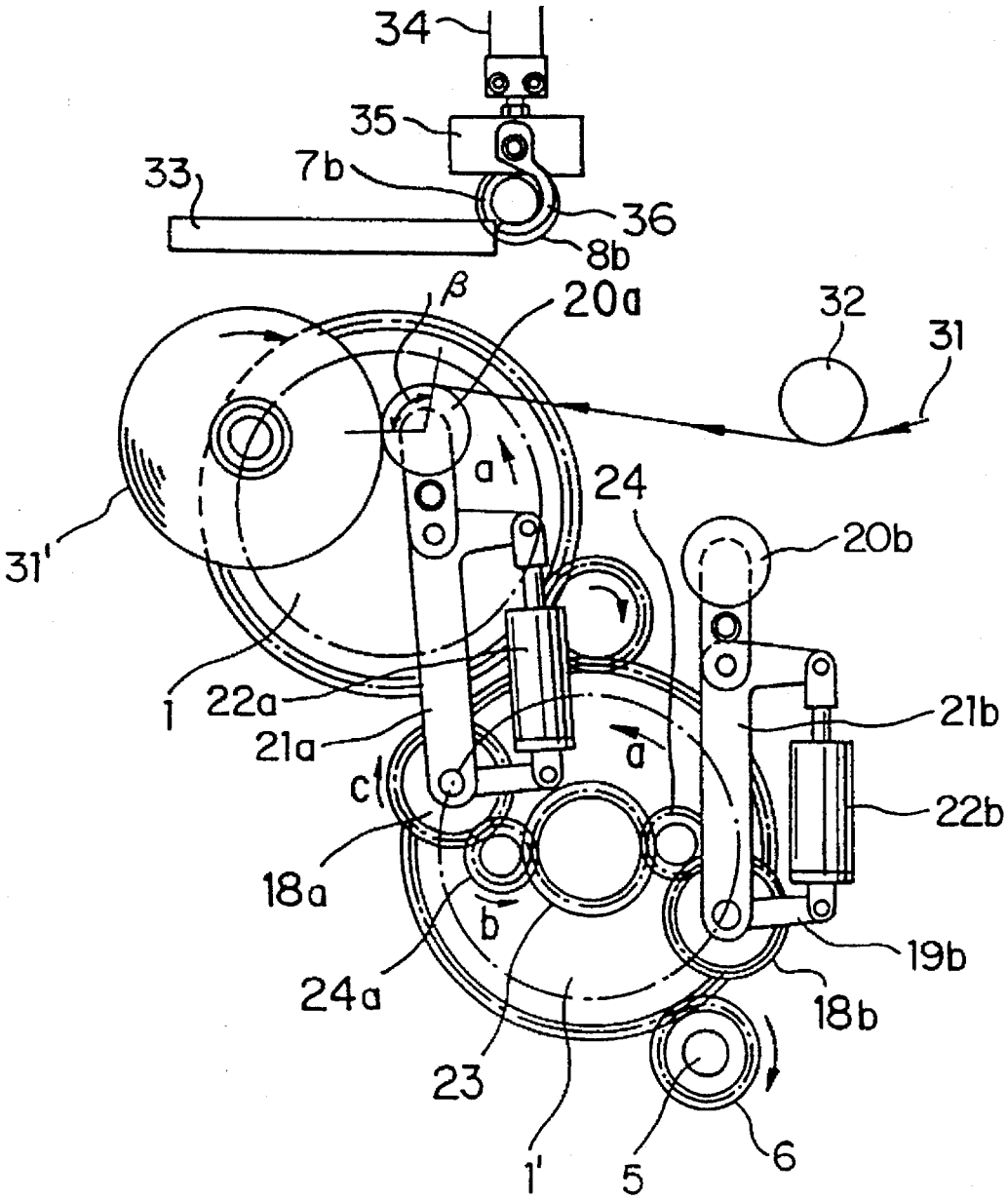
FIG. 2 is a side view of the embodiment shown in FIG. 1 for explaining one operation.

As shown in FIG. 2, if the second turret table 1' is rotated counterclockwise in the direction shown by arrow "a", the idle gears 24*a*, 24*b* rotate counterclockwise in the direction shown by arrow "b", and the planetary gears 18*a*, 18*b* with sleeve members rotate clockwise in the direction shown by arrow "c" and the idle gears 24*a*, 24*b* and the planetary gears 18*a*, 18*b* revolve around the sun gear 23 in the direction shown by arrow "a".

Pitch circles of the sun gear 23 and the planetary gear 18*a* (18*b*) with sleeve member do not engage with each other.

A main arm 19*a* (19*b*) is integrally fixed and supported at one end of the planetary gear 18*a* (18*b*) with the sleeve member. A base portion of a touch roller arm 21*a* (21*b*) is rotatably attached to the main arm 19*a* (19*b*). A touch roll 20*a* (20*b*) is rotatably attached at a front end portion of the touch roller arm 21*a* (21*b*).

An expandable air cylinder 22*a* (22*b*) is provided between the main arm 19*a* (19*b*) and the touch roller arm 21*a* (21*b*), and compressed air is supplied from a compressor (not shown) to the air cylinders 22*a*, 22*b*.

When the air cylinder 22*a* (22*b*) is lengthened/shortened by supplying compressed air, the touch roller arm 21*a* (21*b*) is swung with respect to the main arm 19*a* (19*b*), and the touch roller 20*a* (20*b*) elastically contacts the corresponding winding mandrel 7*a* (7*b*), or is released from the winding mandrel 7*a* (7*b*).

The touch roller 20*a* (20*b*) contacts or approaches the product roll 31' near a position where the plastic film 31 is introduced to the winding mandrel 7*a* (7*b*) and wound by the winding mandrel 7*a* (7*b*) at a winding angle within an appropriate range.

The winding angle of the plastic film 31 at the touch roller 20*a* is shown as an angle β in FIG. 2.

Unless the winding angle to the touch roller 20*a* is proper, air will be introduced between laminated plastic films and wrinkling will occur.

In this embodiment, the touch roller following mechanism includes the sun gear 23, the idle wheels 24*a*, 24*b*, the planetary gears 18*a*, 18*b* with sleeve members, the main arms 19*a*, 19*b*, and the air cylinders 22*a*, 22*b*. However, other mechanisms can be applied to embodiments according to the present invention.

In one embodiment, a cutting device 26 is further provided so as to cut the plastic film 31 when the winding mandrel are exchanged.

Figure 4:
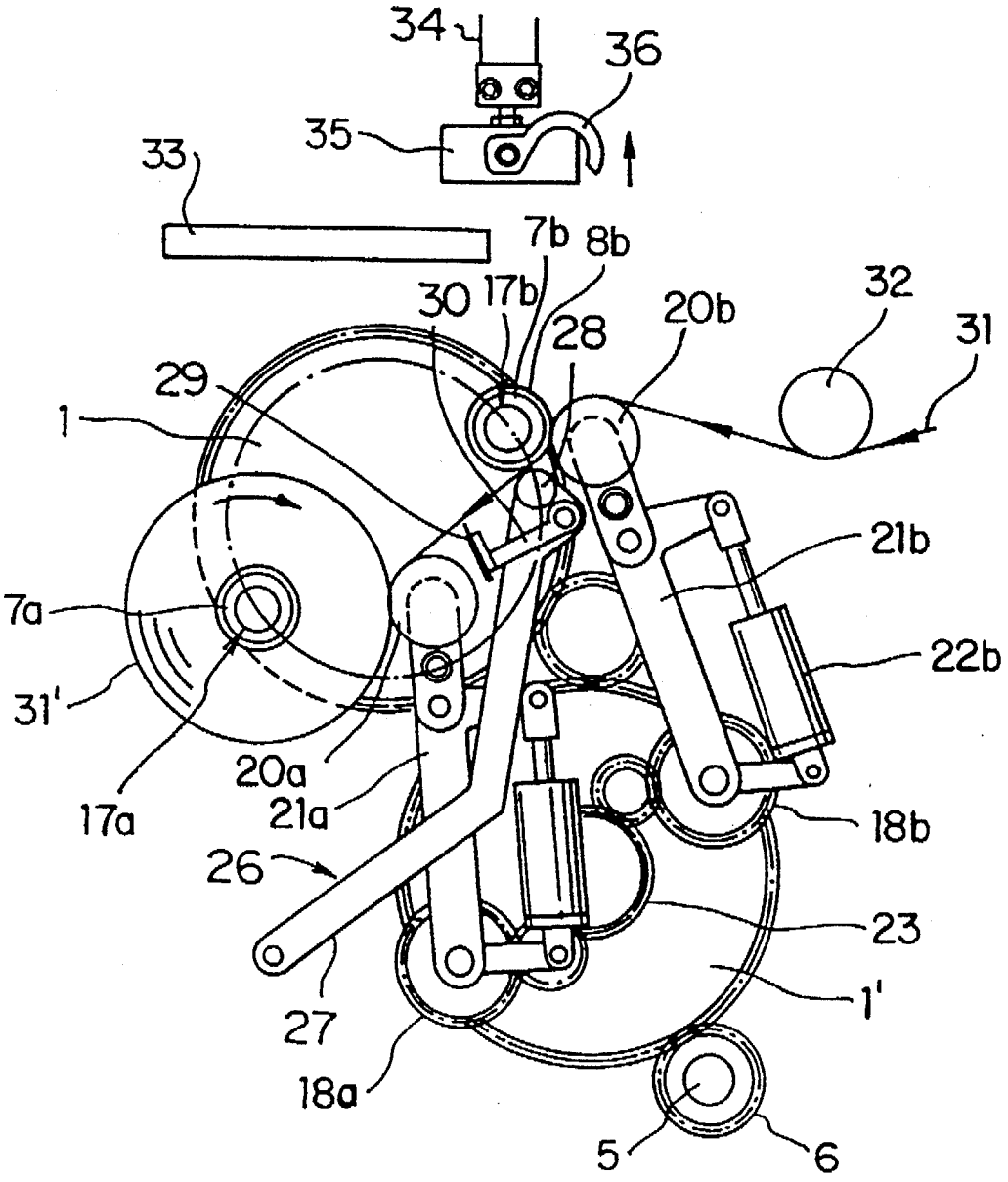
FIG. 4 is a side view of the embodiment shown in FIG. 1 for explaining yet another operation.

As shown in FIG. 4, a main arm 27 is swingably supported and a cutting arm 30 is swingably connected to a front end of the main arm 27. A cutting edge 29 is formed or attached at a tip portion of the cutting arm 30. A charging device 28 is attached at a front end portion of the main arm 27.

The main arm 27 swings near the winding mandrel 7*a* (7*b*) at the winding position A, as shown in FIG. 4, when the winding mandrels 7*a*, 7*b* are exchanged. After exchanging the winding mandrels and cutting the plastic film, the main arm 27 swings backwardly to an original position along the opposite direction.

When the cutting arm 30 is swung under the condition in which the main arm 27 approaches a position near the winding position A, the cutting edge 29 cuts a plastic film 31 stretched between the winding position A and a position B for releasing a product roll 31'.

The electric charging device 28 charges the plastic film at an upstream side of a portion cut by the cutting edge 29. The charged plastic film 31 is applied to the core 8*a* (8*b*), and attached at the winding mandrel 7*a* (7*b*) by static electricity.

In the multi-shaft turret type winding device according to the present invention. The plastic film 31 is wound in accordance with the following operations.

As shown in FIG. 1, the winding mandrel 7*a* is attached at the winding mandrel chucking device 17*a* at the winding position A. The plastic film 31 is wound on the core 8*a* which is previously attached at the winding mandrel 7*a* while the touch roller 20*a*is elastically approached to the winding mandrel 7*a*.

The plastic film 31 is introduced to the touch roller 20*a* through a guide roller 32, and the plastic film 31 is wound on the product roll 31' while the plastic film 31 is elastically applied to the product roll 31' by the air cylinder 22*a*.

Thus, the plastic film 31 is wound to the touch roller 20*a* at an appropriate winding angle by the winding mandrel 7*a* so that air can not be introduced between layers of the plastic film 31 of the product roll 31'.

After a predetermined amount of the plastic film 31 has been wound by the winding mandrel 7*a*, and the core 8*a* becomes full, the first turret table 1 and the second turret table 1' are rotated 180° in the same direction with the same angular velocity by the turret driving motor 39, as shown in FIG. 2.

The product roll 31' located in the winding position A is moved to the position B for releasing a product roll. At the same time, the winding mandrel chucking device 17*b* located at the position B for releasing a product roll moves to the winding position A without being fitted with the winding mandrel 7*b*.

The planetary gears 18*a*, 18*b* with sleeve members move integrally with the respective main arms 19*a*, 19*b* along a circular path having a radius which is the same as that of the winding mandrel chucking devices 17*a*, 17*b*. An angle formed by the planetary gear 18*a* (18*b*) with the sleeve member and the main arm 19*a* (19*b*) is maintained constant with respect to a floor surface while the turret table is rotating.

Therefore, the touch roller 20*a* always follows the product roll 31' while maintaining the same relative position with respect to the product roll 31', so that the touch roller 20*a* is not released from the product roll 31'.

As shown in FIG. 2, even if the turret table is rotating, the plastic film 31 is wound by the touch roller 20*a*, and the plastic film 31 can be wound by the winding mandrel 7*a* while maintaining the proper winding angle with respect to the touch roller 20*a* so that air can not be introduced into the laminated plastic film layers.

Next, as shown in FIG. 3, when the winding mandrel chucking device 17*b* is moved to the winding position A, the winding mandrel 7*b* is hooked by the hook 36 which is moved down by the air cylinder 34, and the winding mandrel 7*b* is attached to the winding mandrel chucking device 17*b*. The core 8*b* is previously attached at the winding mandrel 7*b*.

After the winding mandrel 7*b* has been attached, the hook 36 is swung by the air cylinder 35 in order to release the winding mandrel 7*b* from the hook 36. Then, the hook 36 is moved up to the original position by the air cylinder 34.

The winding mandrel 7*b* is supported by the winding mandrel chucking device 17*b*, and a peripheral velocity of the winding mandrel 7*b* is increased so that a peripheral velocity of the core 8*b* is the same as the speed of the plastic film 31.

As shown in FIG. 4, the touch roller arm 21*b* is rotated by the air cylinder 22*b* in order to contact the touch roller 20*b* with the core 8*b* attached at the winding mandrel 7*b*.

Further, the main arm 27 is rotated, and a front end of the main arm 27 approaches a position near the winding position A. Then, the cutting arm 30 is swung in order to cut the plastic film 31 stretched between the winding position A and the position B by the cutting edge 29.

An upstream side of the cut plastic film 31 is attracted to the core 8*b* attached at the winding mandrel 7*b* by static electricity generated by the charging device 28, and the cut plastic film 31 is wound by the winding mandrel 7*b*. Then the winding operation of the plastic film 31 continues.

After the winding mandrel have been exchanged, the cutting arm 30 and the main arm 27 are backwardly rotated to the original position, and the rotation of the winding mandrel 7*a* stops automatically.

After the rotation of the winding mandrel 7*a* has stopped, the product roll 31' is discharged from the winding mandrel chucking device 17*a* together with the winding mandrel 7*a*. Then, the winding mandrel 7*a* is pulled out from the product roll 31' and a new core 8*a'* is attached to the winding mandrel 7*a*. The winding mandrel 7*a* is attached to the hook 36 located beside the guide rails 33.

In the above described embodiment, there are two winding mandrel. However, more than two winding mandrel can be arranged on a first turret table. In this case, a position B for releasing a product roll 31' might be different from the position B explained in the above described embodiment. In addition, in the above described embodiment, one touch roller is provided for each winding mandrel. However, a plurality of touch rollers may be provided for each winding mandrel. Further, a touch roller following mechanism can employ a mechanism in which main arms 19*a*, 19*b* can rotate independently of the planetary gears 18*a*, 18*b*, and other various mechanisms.

Regarding the first and second turret tables 1, 1', the tables may be synchronously rotated without using the ring gears 4, 4' and the ball bearings 12, 12'.

Although the above embodiment is explained for winding a plastic film, other thin layer band made of paper, cloth or other materials can be applied to a multi-shaft turret type winding device according to the present invention.

As described above, in a multi-shaft turret type winding device according to the present invention, when a turret table is rotated in order to exchange a winding mandrel with a product roll for a new winding mandrel, at least one touch roller touches or approaches the product roll near a point where a thin layer band material is wound by the winding mandrel at an appropriate winding angle, and without changing a relative position of the touch roller with respect to the product roll. Even if a position of the product roll is changing, the touch roller can follow the film, and air is not introduced between laminated layers of the product roll when the winding mandrel is exchanged, so that wrinkled or improper portions can be prevented from occurring on a product roll. In the present invention, it is unnecessary to unwind a product roll for removing wrinkled or improper portions, and therefore the productivity is much improved over the conventional devices.

What is claimed is:

1. A multi-shaft turret type winding device comprising:

(a) a rotatable first turret including a plurality of rotatably supported winding mandrels for winding a thin layer band material in order to form a product roll, wherein said winding mandrels are moved to different positions by rotating said rotatable first turret;

(b) a rotatable second turret including a plurality of fixing axes arranged on said rotatable second turret, and corresponding to respective ones of said winding mandrels;

(c) a plurality of touch roller arms, each one of said touch roller arms having an associated touch roller and being pivotably attached at an associated one of said fixing axes, said thin layer band material partially circumscribing said touch roller when said thin layer band material is wound around said winding mandrel; and (d) a touch roller following mechanism for moving said touch roller arms so that said associated touch roller always maintains a constant relative position with respect to the wound product roll upon rotation of said first turret.

2. A multi-shaft turret type winding device as claimed in claim 1, wherein said touch roller following mechanism comprises:

a plurality of main arms, each one of said main arms attached to a respective one of said fixing axes;

a pressure applying member provided between each one of said main arms and each one of said touch roller arms for biasing said touch rollers against the thin layer band material being wound in a roll shape.

3. A multi-shaft turret type winding device as claimed in claim 1, further comprising a transmitting gear for synchronously rotating said first and second turrets in the same direction and at the same angular velocity.

4. A multi-shaft turret type winding device as claimed in claim 2, wherein said touch roller following mechanism further comprises a stationary sun gear, idle gears rotatably supported on said second turret and engaged with said sun gear, and planetary gears rotatably supported on said second turret and engaged, respectively, with said idle wheels wherein said planetary gears have rotatably supported sleeves that are fixedly secured to said main arms, respectively.

5. A multi-shaft turret type winding device as claimed in claim 1, further comprising means for rotating the first and second turrets synchronously in the same direction and at the same angular velocity.

6. A multi-shaft turret type winding device comprising:

(a) a rotatable first turret including a plurality of rotatably supported winding mandrels for winding a thin layer band material in order to form a product roll, wherein said winding mandrels are moved between first and second positions by rotating said rotatable first turret, said first position corresponding to a position at which said winding occurs, and said second position corresponding to a release position;

(b) a rotatable second turret including a plurality of fixing axes arranged on said rotatable second turret, and corresponding to respective ones of said winding mandrels;

(c) a plurality of touch roller arms, each one of said touch roller arms having an associated touch roller and being pivotably attached at an associated one of said fixing axes, said thin layer band material partially circumscribing said touch roller when said thin layer band material is wound around said winding mandrel at said first position; and (d) a touch roller following mechanism for moving said touch roller arms so that said associated touch roller maintains contact with the wound product roll upon rotation of said first turret from said first position to said second position.

7. A multi-shaft turret type winding device as claimed in claim 6, wherein said touch roller following mechanism maintains the relative positioning of said touch roller and said wound product roll constant during said rotation of said first turret from said first position to said second position.

* * * * *